US007100327B2

(12) United States Patent
Rangabasyam et al.

(10) Patent No.: US 7,100,327 B2
(45) Date of Patent: Sep. 5, 2006

(54) CASEMENT WINDOW SYSTEM AND COMPONENTS AND HARDWARE THEREFOR

(75) Inventors: Madan Chandragiri Rangabasyam, Brampton (CA); Ronald Fredrick Edger, Bolton (CA)

(73) Assignee: Royal Group Technologies Limited, Woodbridge (CA)

( * ) Notice: Subject to any disclaimer, the term of this patent is extended or adjusted under 35 U.S.C. 154(b) by 0 days.

(21) Appl. No.: 10/281,199

(22) Filed: Oct. 28, 2002

(65) Prior Publication Data

US 2003/0079414 A1 May 1, 2003

(30) Foreign Application Priority Data

Oct. 30, 2001 (CA) ..... 2360634

(51) Int. Cl.
*E05C 9/00* (2006.01)

(52) U.S. Cl. ..... 49/395; 49/339; 49/504; 49/DIG. 2; 292/161; 292/DIG. 20; 292/DIG. 33

(58) Field of Classification Search ..... 49/394, 49/395, 339, 504, DIG. 2; 292/156, 157, 292/158, 161, 139, 143, 146, 190, DIG. 20, 292/DIG. 33
See application file for complete search history.

(56) References Cited

U.S. PATENT DOCUMENTS

| | | | | | |
|---|---|---|---|---|---|
| 4,610,472 | A * | 9/1986 | Billingsley | 292/54 |
| 4,676,026 | A * | 6/1987 | Schreiner | 49/501 |
| 4,768,316 | A * | 9/1988 | Haas | 52/71 |
| 4,803,808 | A * | 2/1989 | Greisner | 49/394 |
| 4,974,364 | A * | 12/1990 | Durham, Jr. | 49/400 |
| 5,118,145 | A * | 6/1992 | Tucker | 292/158 |
| 5,553,420 | A * | 9/1996 | Klimek | 49/501 |
| 5,687,519 | A * | 11/1997 | Bruchu | 52/213 |
| 5,692,349 | A * | 12/1997 | Guillemet | 52/204.53 |
| 6,109,668 | A * | 8/2000 | Demarco | 292/161 |
| 6,135,511 | A * | 10/2000 | Smith et al. | 292/156 |
| 6,431,620 | B1 * | 8/2002 | Tremblay et al. | 292/263 |
| 6,530,179 | B1 * | 3/2003 | Fisher et al. | 49/397 |
| 6,749,797 | B1 * | 6/2004 | Kownacki et al. | 264/572 |

* cited by examiner

*Primary Examiner*—Jerry Redman

(57) ABSTRACT

Injection molded casement window frames completely ready for assembly into windows with the frames for swinging sash windows formed for mounting of all necessary hardware. Also hardware which mates with such frames and casement window assembled with such frames and hardware.

8 Claims, 15 Drawing Sheets

1
2
15
16
17
17a
18
18a
18b
19
20
21
22
34
35
36
37
38
39

26
57
56
27
29
25
26
28
30
27
25
26
49
48
45
43

30
26
27
29
25
26
28
30
26
30
47
45

FIG. 21.
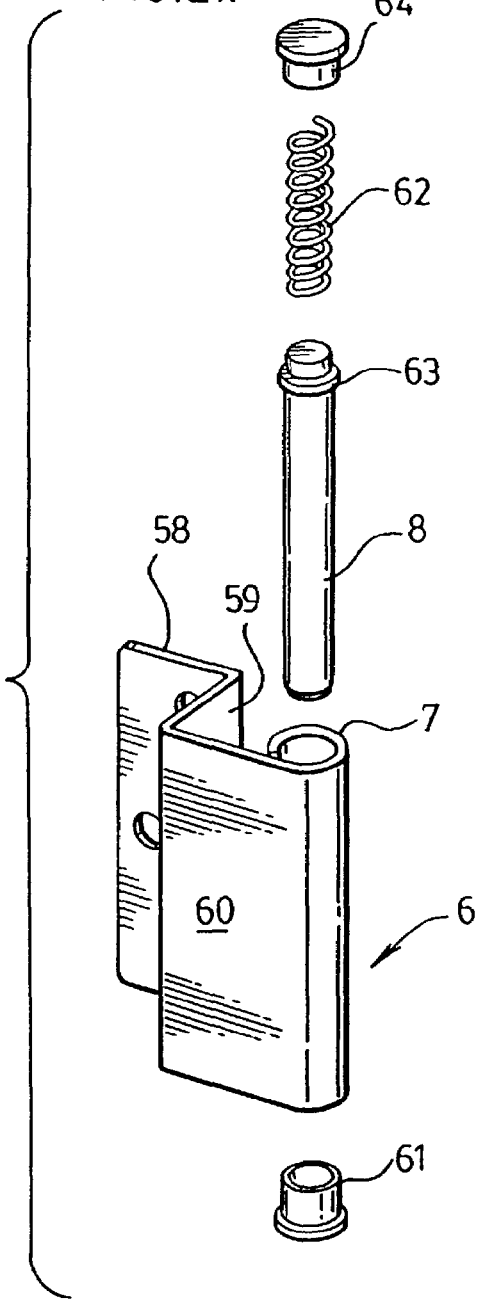
FIG. 23.
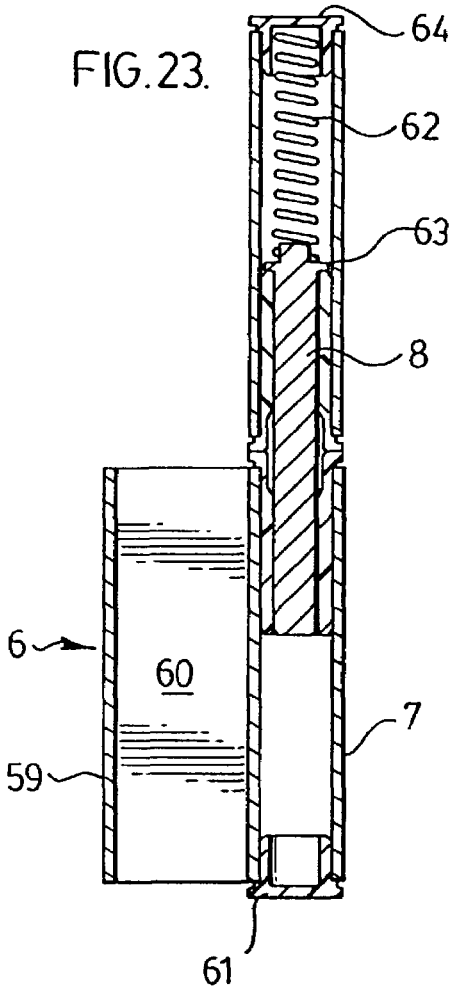
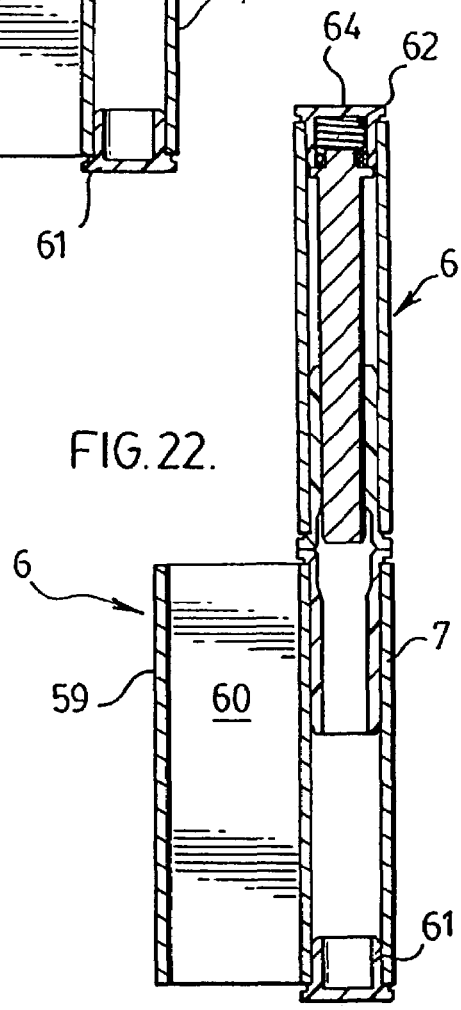
FIG. 22.

CASEMENT WINDOW SYSTEM AND COMPONENTS AND HARDWARE THEREFOR

FIELD OF THE INVENTION

This invention relates to casement windows generally and particularly to casement windows where the window sash is swingably mounted in the window frame and opens outwardly, for example, by means of a crank located conventionally at one side or the other of the window frame.

BACKGROUND OF THE INVENTION

Conventionally, the manufacturer of casement windows whether the fixed window or swinging sash type starts with an extruder who extrudes the window frame and sash profiles to meet the requirements of the customer who is the actual window manufacturer who then fabricates the frames from these profiles.

To complete the windows, these fabricators must assemble the window frame and glazing unit and in the case of the swinging sash must purchase the necessary hardware to mount the sash in the window frame for its opening and closing function; the operating hardware for effecting the opening and closing movement of the sash; and the hardware for locking the sash in the closed position.

Customers of the swinging sash window fabricators will, of course, require windows of different sizes so that the fabricator must keep an inventory of hardware to fit the various sizes of windows he is required to supply. Further, the mounting of the hardware requires some machining of the frames assembled from the profiles supplied.

It will be appreciated that if the profiles are not accurately cut and assembled into the frames or subsequently properly machined to receive the hardware they become expensive waste items so that all in all the cost of the material in the form of the extrusions, the hardware for swinging sashes, potential waste costs, and costs in assembling the frames and the hardware costs make such casement window relatively expensive.

Moreover, conventional swinging sash casement windows for the residential market provide a window opening movement in which the sash is operated from an operator at one side of the window frame and swings to a position where it extends outwardly from the window frame at some point between the sides of the window frame thus reducing the egress area of escape through the window to just a portion of the size of the window frame opening.

Again, it will be appreciated that in some cases it is desirable that the window sash open outwardly towards the left and sometimes to open outwardly towards the right depending upon the window arrangement into which the casement window is to be incorporated. To provide for this flexibility of the customers demands, the fabricator must carry the necessary extensive hardware inventory to accommodate the customer's selection.

It is the object of the present invention to provide a new casement window manufacturing system and frames and matching hardware therefore which will greatly simplify the manufacture and materially reduce the costs of, and the time taken to, produce casement windows and to provide such windows which have important functional advantages over conventional casement windows.

SUMMARY OF THE INVENTION

In its broadest aspect the invention resides in eliminating the use of extruded frame profiles and the need to assemble these profiles into the requisite frames by the window fabricators and instead as a supplier to the window fabricators to provide the fabricators with precisely accurate molded frames ready for assembly into casement windows.

With respect to swinging sash casement windows, another aspect of the invention involves producing and supplying, along with the molded frame, novel hardware to mate with the frames to provide for quick and easy and correct attachment of the hardware to the frame and assembly of the frames to complete the casement window without any machining of the frames.

In this connection the frames are molded to accept without machining hardware for swinging the sash in the usual window installation to open outwardly either to the left or right and to provide upon opening essentially the entire window frame opening as an egress escape route.

More particularly, in this connection, according to the preferred form of the invention, the window frame provides for the mounting of the sash operator at a central location whether the window opens to the left or to the right.

In keeping with the preferred form of the molded window frame, provision is made for mounting of a locking device at either side of the window to enable locking of the window whether opening to the left or to the right when closed.

Again, according to the preferred form of the invention, the mating hardware for the molded frames is formed to be expanded by means of simple extensions to accommodate casement windows of different sizes so that the fabricator of the casement windows need maintain a minimum inventory of hardware parts produced according to the invention both for windows opening to the left and to the right and for different sizes of window such as three foot, four foot or five foot windows.

Still another feature of the invention resides in the manner of assembly of the glass pane or glazing member with its supporting frame whether the supporting frame is a sash for a casement window with a swinging sash or the supporting frame is the window frame for a fixed window casement window.

These and other features of the invention will become apparent from the following detailed description taken in conjunction with the accompanying drawings showing a casement window with a swingable sash.

BRIEF DESCRIPTION OF THE DRAWINGS

FIG. 21 is an exploded perspective view of one of the members of the hinge which is to carry the spring loaded pin;

FIG. 22 is a vertical sectional view showing the barrel of the hinge member shown in FIG. 21 in vertical alignment with the barrel of the lower or under mating hinge member with the spring loaded pin retracted ready to enter the barrel of the lower mating hinge member;

FIG. 23 is a view similar to FIG. 22 but showing the spring loaded pin carried in the barrel of the upper hinge member projected into the barrel of the under hinge member.

DETAILED DESCRIPTION ACCORDING TO THE PREFERRED EMBODIMENTS OF THE PRESENT INVENTION

Figure 1:
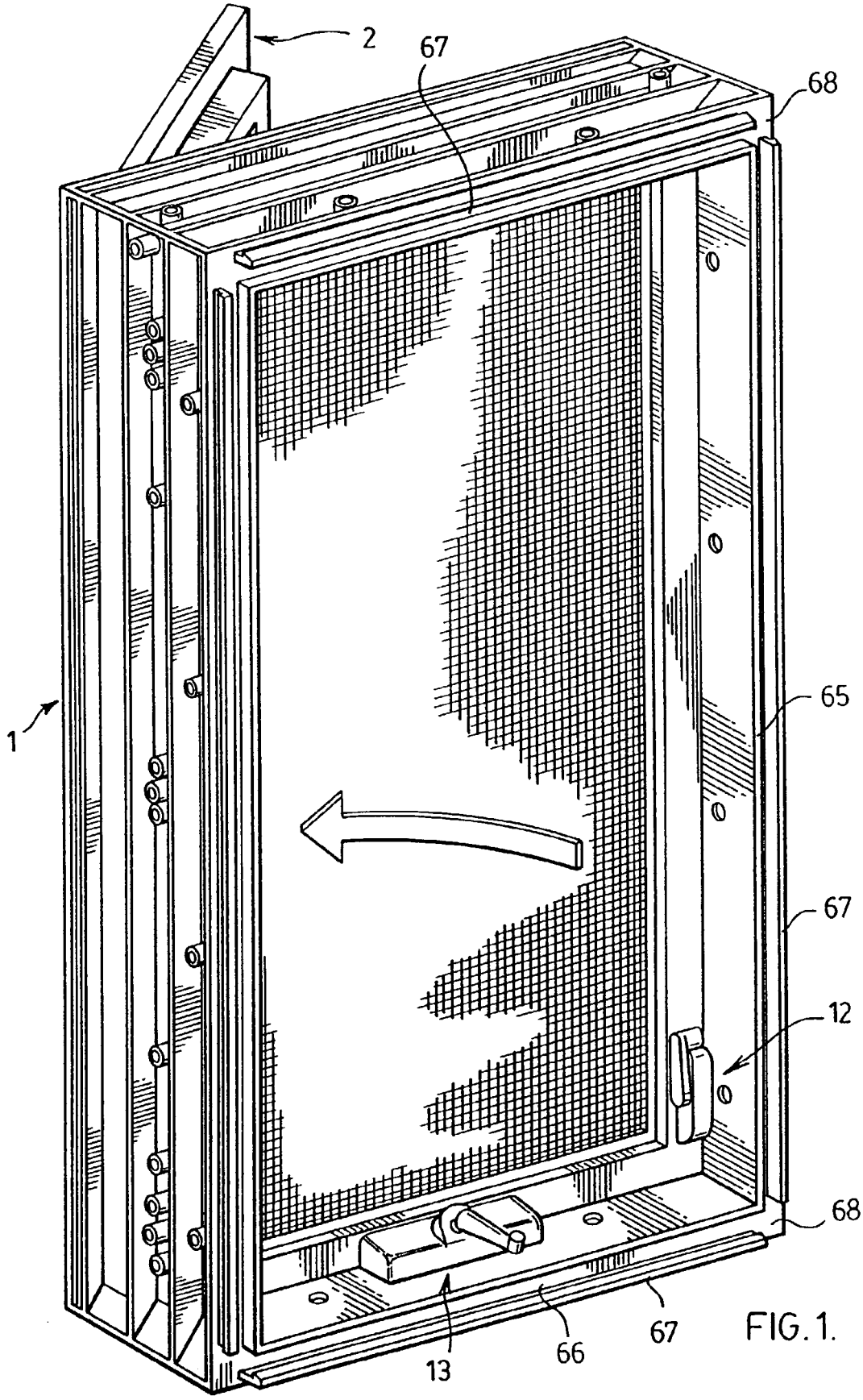
FIG. 1 is a perspective view taken from the inside of a casement window according to the invention and showing the sash partially opened to the left.
Figure 2:
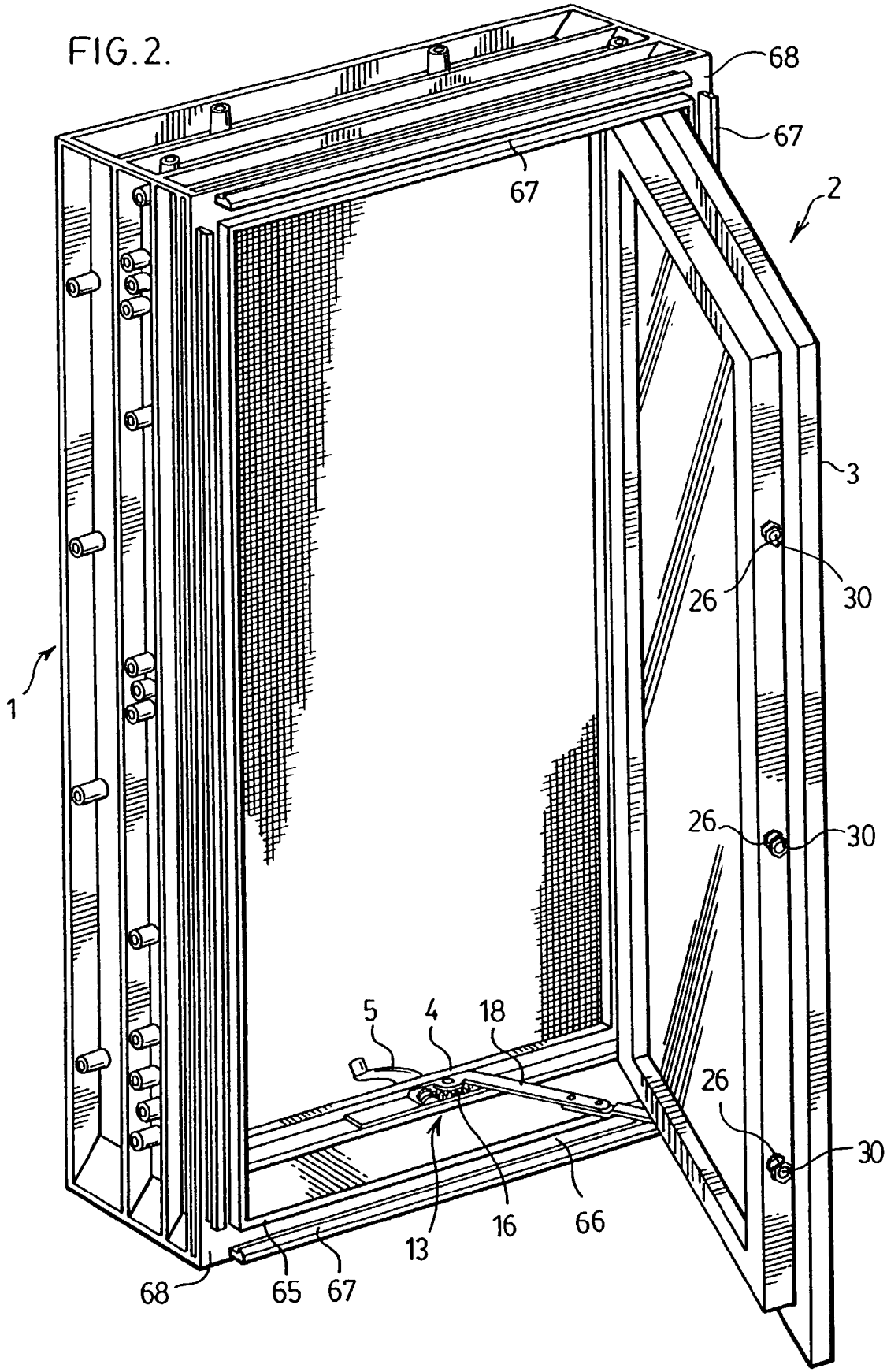
FIG. 2 is a perspective view of the casement window of FIG. 1 taken from outside the window showing the sash in the partially opened position.

With reference first to FIGS. 1 and 2, the casement window illustrated therein comprises a one piece molded window frame generally designated at 1 preferably formed by injection molding to which is hinged a sash generally designated at 2, the frame 3 of which is again a one piece molded unit preferably produced by injection molding.

Opening and closing operation of the sash 2 is controlled by an operating mechanism generally designated at 13 hereinafter more fully described mounted centrally of the width of the sill 4 of the window frame and operated by a crank handle 5.

The window frame 1 is adapted for mounting of the sash 2 to swing open to the left or alternatively to swing open to the right. In FIGS. 1 and 2, the sash 2 is shown mounted to swing open to the left as viewed from the inside of the window.

To provide this swinging movement, the sash is hinged to the window frame by specially developed hinges comprising hinge members 6, one mounted on the window frame and one mounted on the sash frame, so arranged that their hinge barrels 7 are brought into vertical registration to receive a pin 8 which is projected from the upper member 6 into the hinge barrel of the lower member 6 as hereinafter more fully explained.

The hinge member 6 secured to the window frame is mounted on wall 9 and the hinge member 6 secured to the sash frame 3 is mounted on wall 10 at right angles to the plane of the sash.

Figure 3:
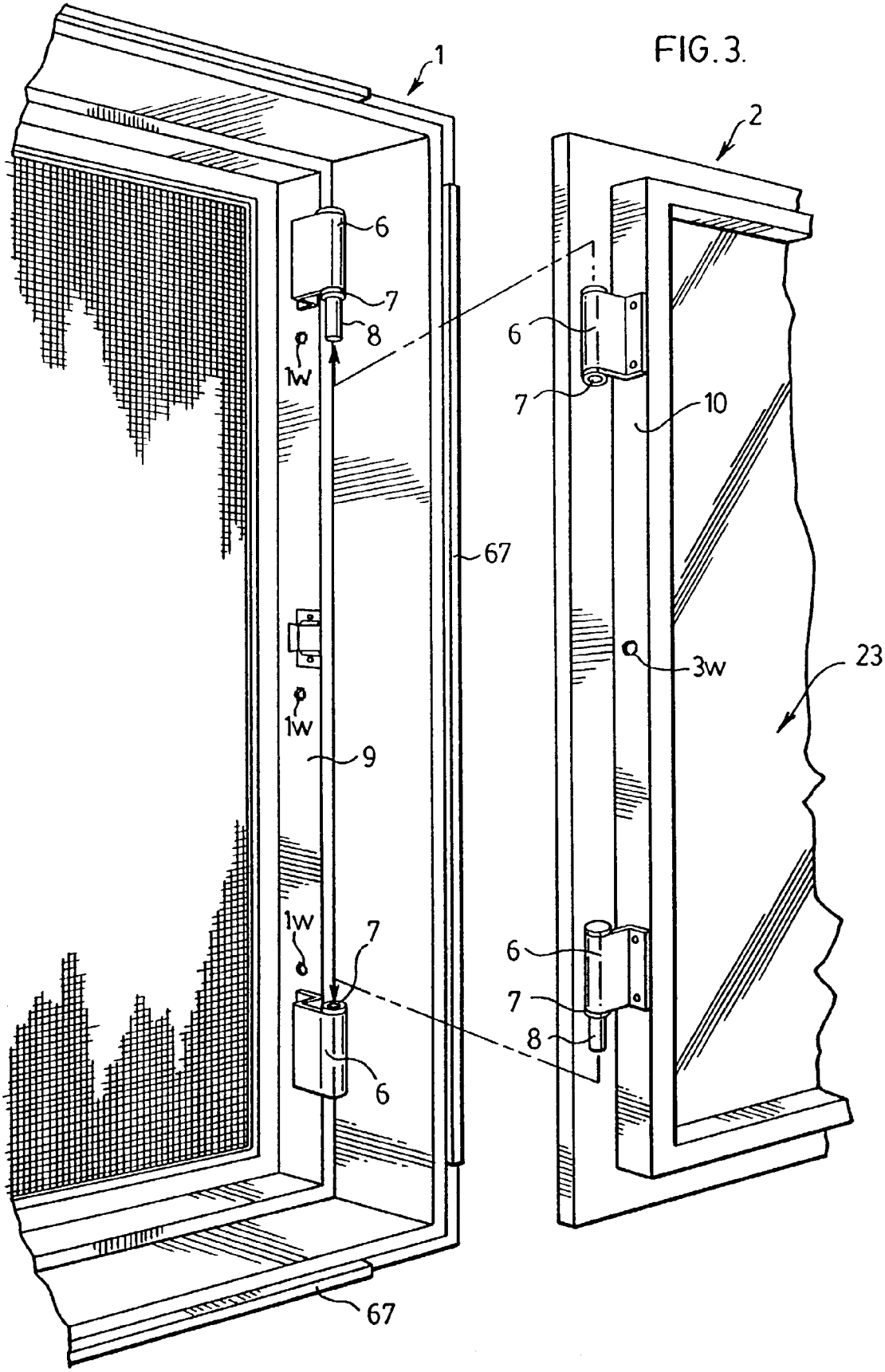
FIG. 3 is a broken away perspective view showing the sash separated from the window frame ready to be hinged thereto.

Since the sash may be mounted to swing open in either direction, it will be understood that the opposite side of the window frame 1 will be identical with the side shown in FIG. 3 and similarly the opposite side of the sash frame 3 will be identical with the side shown in FIG. 3.

Figure 4:
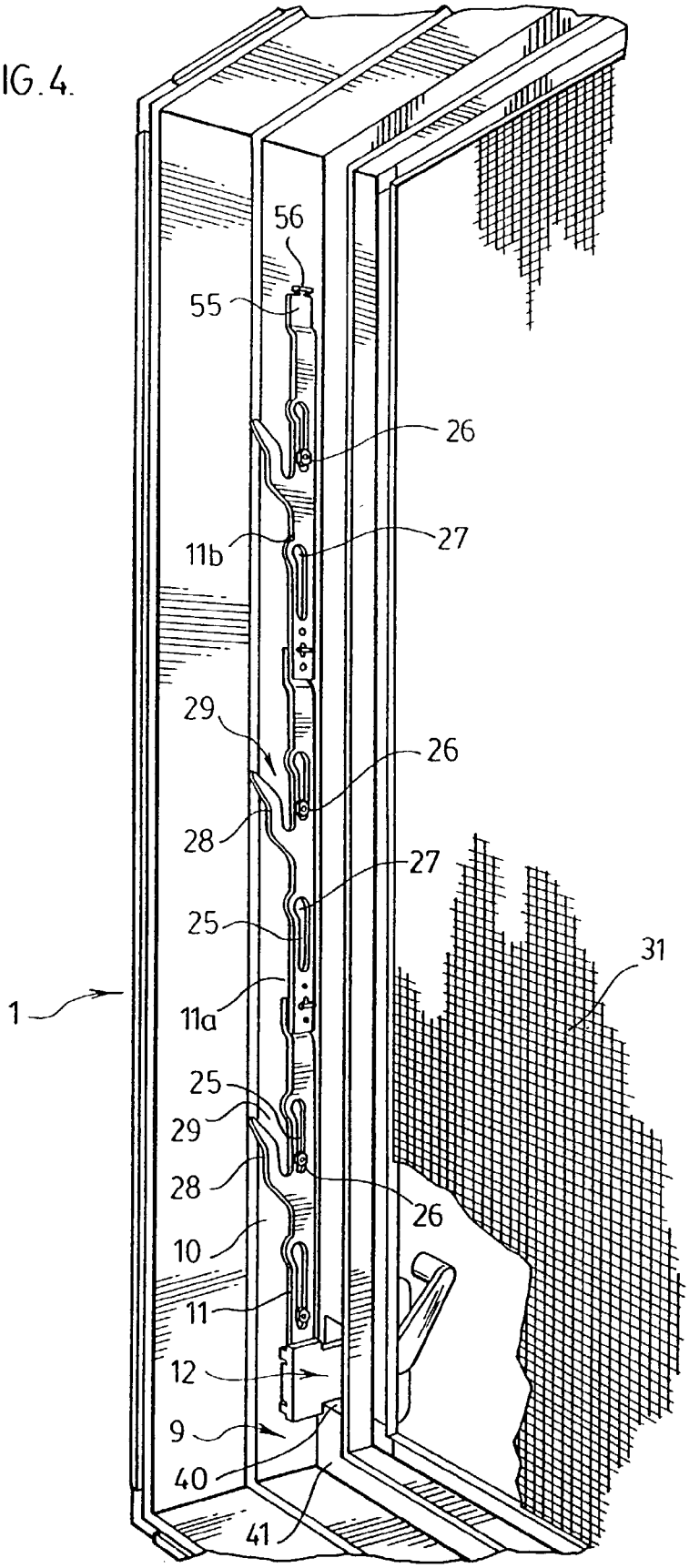
FIG. 4 is a broken away perspective view showing the locking mechanism for locking the sash in the closed position.

The walls 9 on both sides of the window frame 1 also provides for the mounting of an elongated bar 11 of the locking mechanism generally designated at 12 in FIG. 4.

It will be understood that the locking bar 11 will be mounted at the side of the window frame opposite to the hinges 6.

Figure 5:
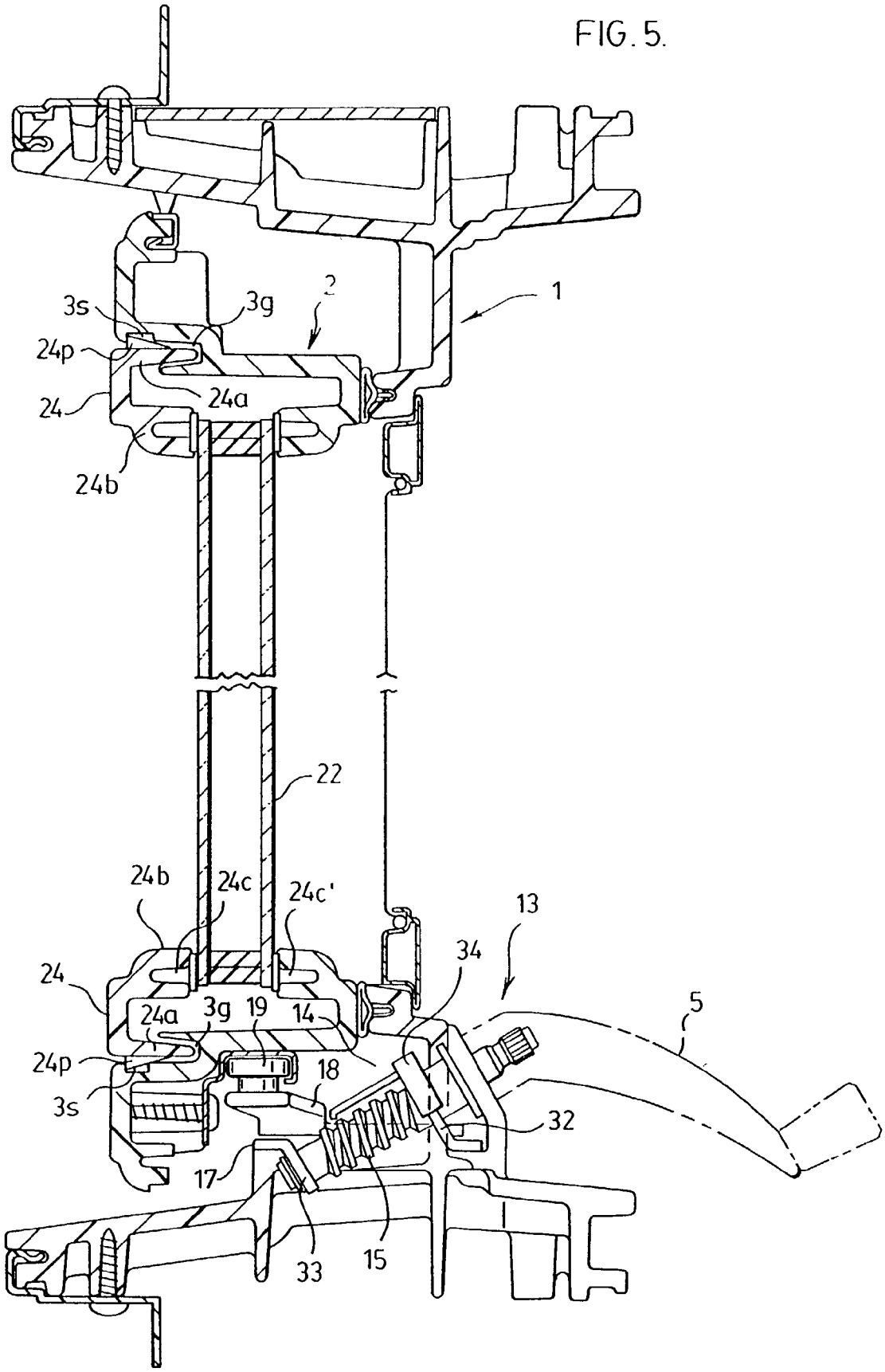
FIG. 5 is a vertical sectional view of the casement window with the sash closed and showing the sash operating mechanism.
Figure 6:
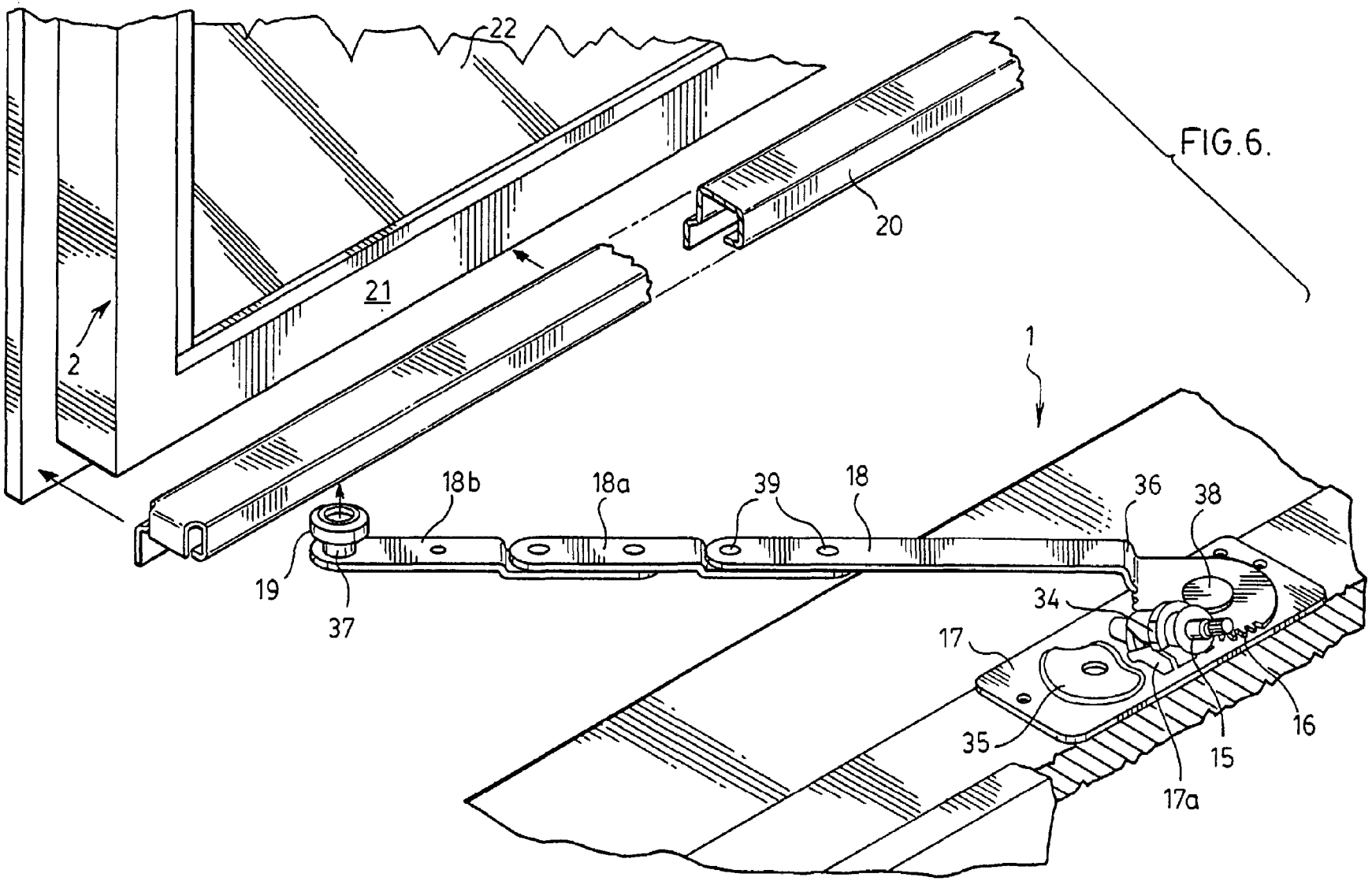
FIG. 6 is a broken away exploded perspective view showing the operating mechanism which mounts on the window frame sill about to be assembled with the sash trackway.

With reference to FIGS. 5 and 6, it will be seen that the operating mechanism 13 is received in a recess 14 in the sill 4 of the window frame 1 (FIG. 5) and includes a worm gear 15 operated by the crank or handle 5. This worm gear in turn engages a gear 16 mounted on a plate 17 as hereinafter more particularly described.

Gear 16 is attached to an operating arm 18 which carries a wheel 19 at its outer end which engages in a trackway 20 secured to the underside of the sill 21 of the sash frame 3. The arrangement is such that operating the crank arm 5 turns the worm gear 15 which in turn meshing with the gear 16 which swings the arm 18 to run the wheel 19 along the track 20 formed to contain the wheel to effect swinging movement of the sash on its hinge connections to the window frame.

Figure 10:
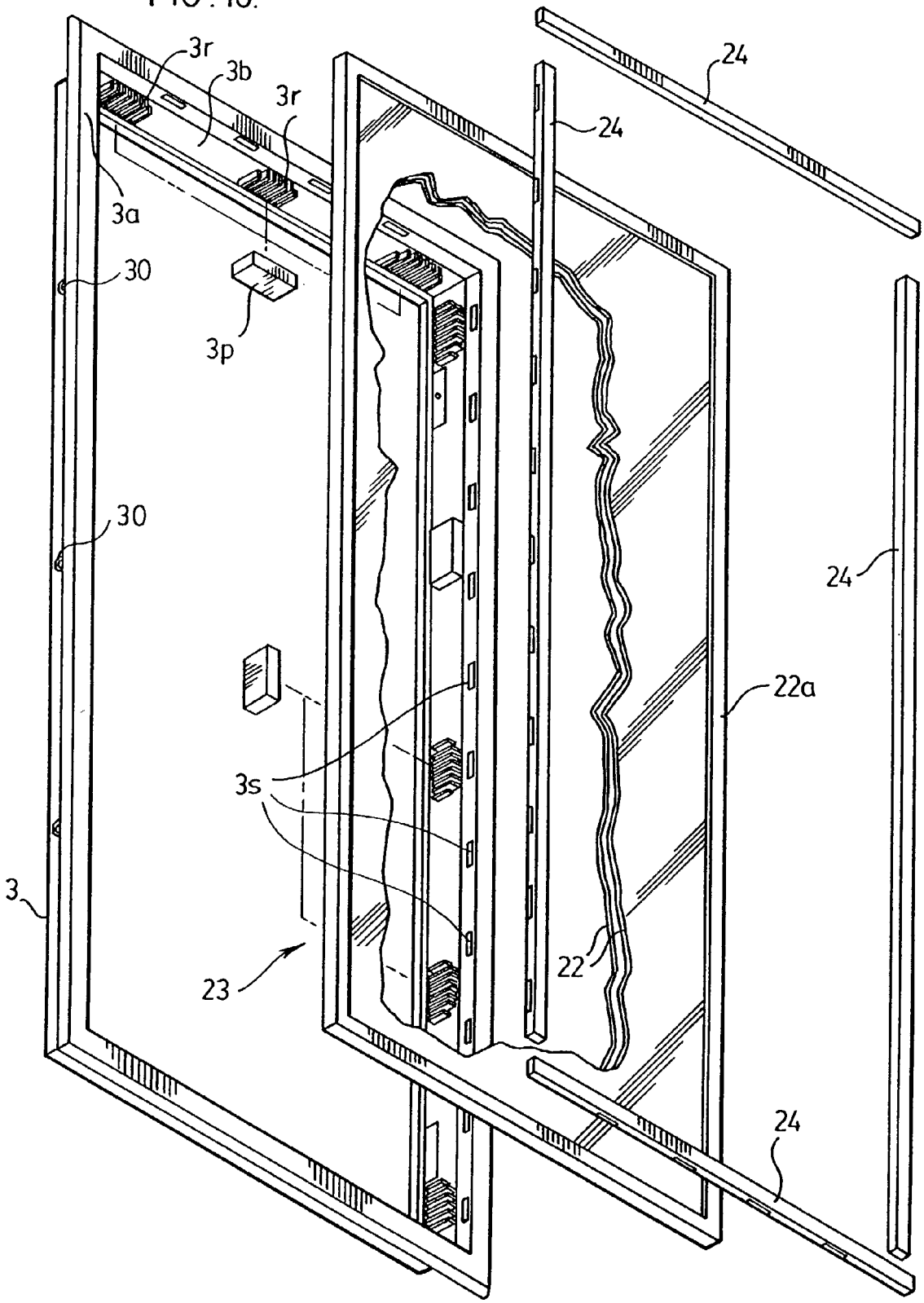
FIG. 10 is an exploded broken away perspective view of the window sash.

With reference first to FIG. 10, the sash frame 3 has a frame border wall 3*a* and an inwardly projecting stop wall 3*b*.

The inside of the wall 3*a* is provided with a series of slots 3*s* therein while the wall 3*b* is provided with a series of spaced ribs 3*r* for supporting rubber blocks or pads 3*p* to cushion the panes of glass 22 held apart by the spacer frame 22*a* constituting the glazing unit 23.

Figure 7:
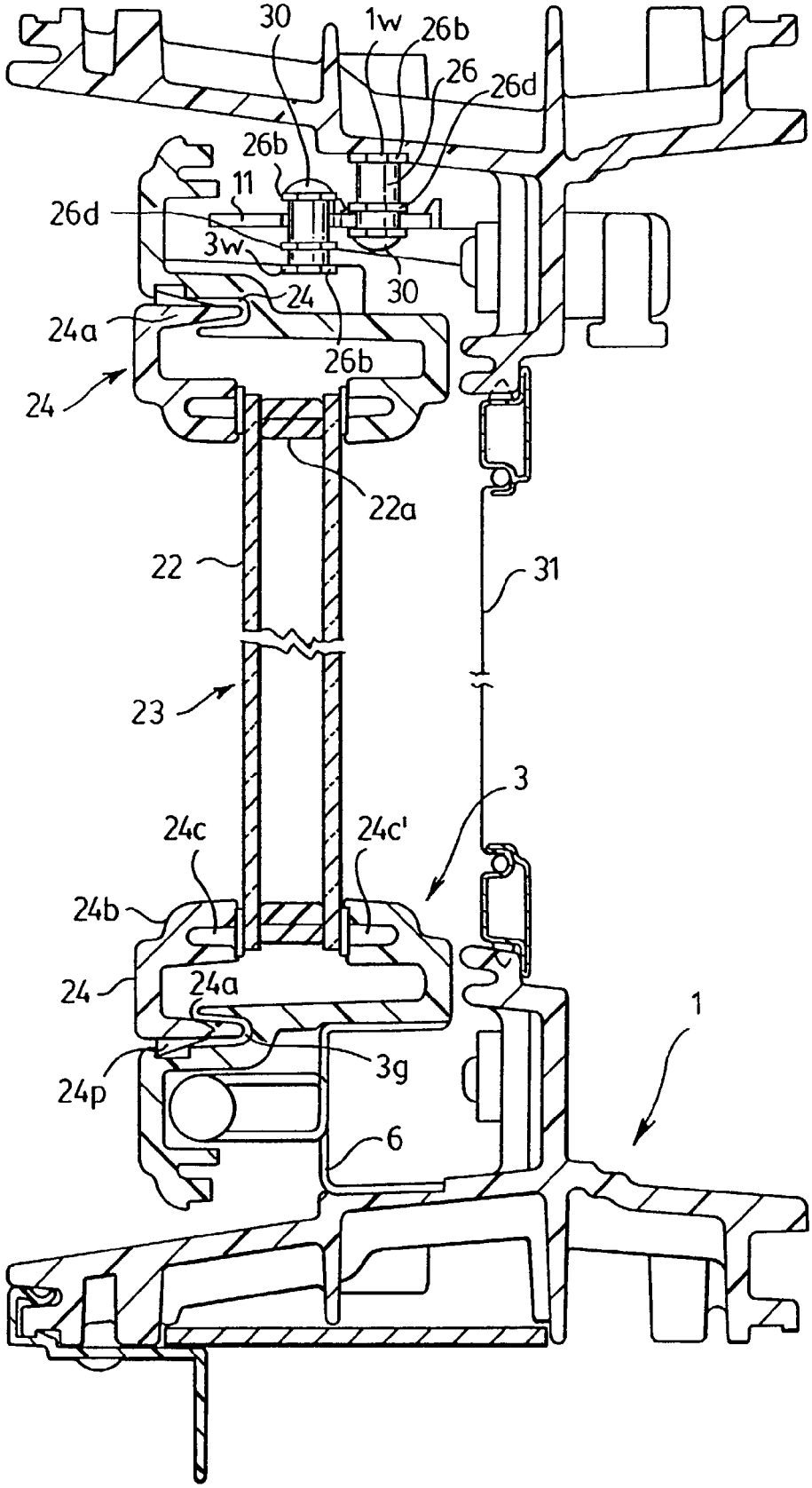
FIG. 7 is a horizontal sectional view showing the sash locked in the closed position.

The glazing unit 23 is secured to the sash frame with the usual double sided tape (not shown) while four locking bars 24 are employed to lock the glazing unit in place. The details of these members 24 and their locking further is shown in FIGS. 5 and 7. It will be understood that except for their lengths the bars are the same having the same cross sectional shape.

Referring to FIG. 5 which shows the bars 24 locking the top and bottom of the glazing unit 23 in the sash frame 3, as seen, the cross sectional shape of each bar 24 is in the form of a channel having one leg in the 24*a* defining a tongue which projects into a peripheral groove 3*g* formed in the frame 3. The other leg 24*b* of the bar 24 carries a resilient or compressible member 24*c* which engages the glass at one side of the glazing unit 23 while the other side of the glazing unit 23 is supported by a corresponding resilient or compressible member 24*c*' carried by the sash frame 3.

The leg 24*a* has formed on the outer side thereof with a series of integral tapered projections or barbs 24*p* spaced to match the spacing of the slots 3*s* in the sash frame. The arrangement is such that when the bar 24 is forced into the frame groove 3*g* the outer ends of these projections 24*p* will snap into the sash slots 3*s*.

Because of the taper of the projections 24*p*, the bar 24 will be cammed to press the bar leg 24*b* with its resilient member 24*c* against the glass 22 to held the glazing unit 23 securely locked in place in the sash frame 3. To release the glass or glazing unit 23 the barbs 24*p* would have to be released from the slots 3*s*.

It will be understood that this same glazing unit locking arrangement is equally applicable to a fixed window casement window where the frame in which the glazing unit is locked is a window frame instead of a sash frame.

Turning to the operating mechanism 13, since the sash can be mounted to swing in either direction, it will be understood that, as hereinafter more particularly described, the mounting plate 17 is formed for mounting a gear corresponding to gear 16 shown in FIG. 6 for swinging the sash in the opposite direction.

The operating arm 18 driven by gear 16 is made up of a base arm 18(*a*) and extensions 18(*b*) which can be added as desired to accommodate windows of different widths.

In a similar vein, dealing with the locking mechanism 4, it will be seen from FIG. 4 that the locking bar 11 is formed with a base bar 11(*a*) and extension bars 11(*b*) adapted to be fitted together to accommodate windows of different heights.

Figure 14:
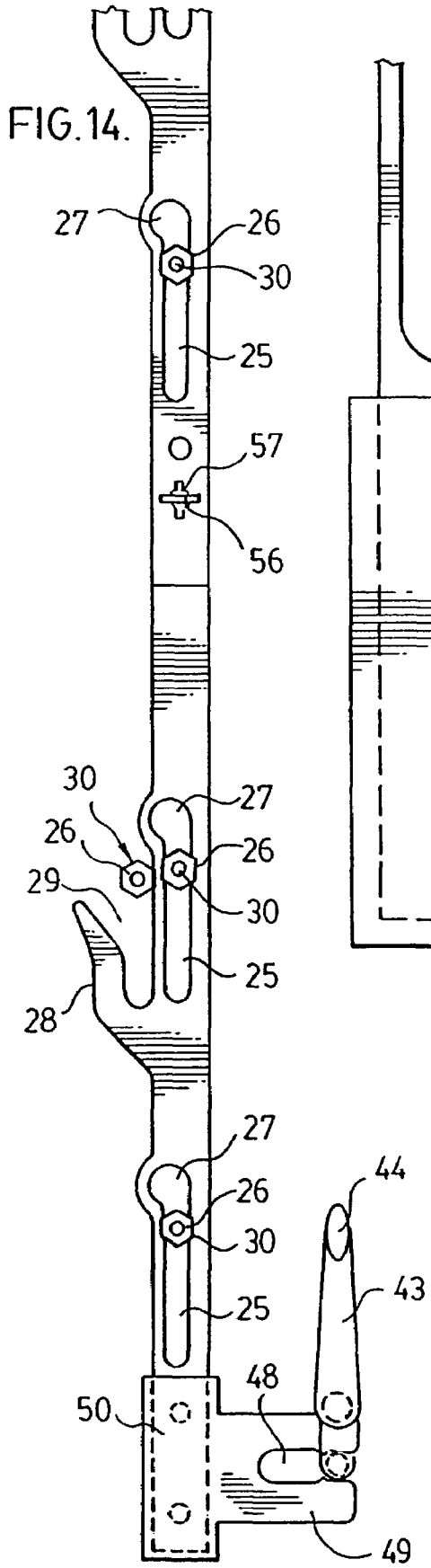
FIG. 14 is an elevational view of the sash locking mechanism and showing the mechanism in the unlocked position.
Figure 15:
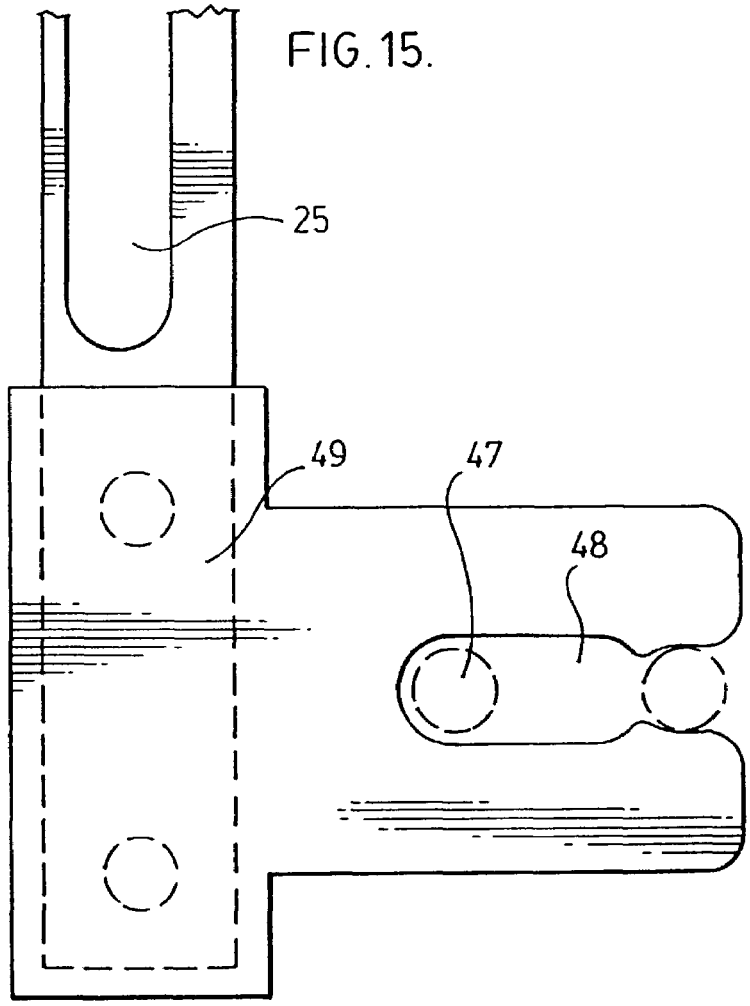
FIG. 15 is an enlarged elevational view of the connection between the sash locking bar and the locking lever or handle.
Figure 14A:
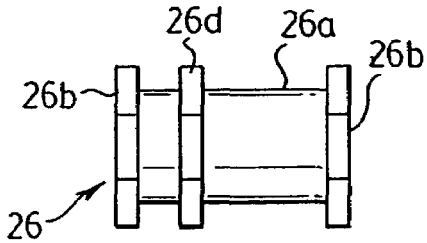
FIG. 14*a* is a side elevational view of one of the studs used for controlling the locking bar movement and for cooperating with the locking bar hook.
Figure 14B:
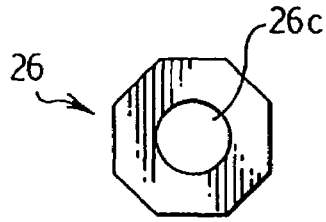
FIG. 14*b* is an end view of the stud of FIG. 14*a;*

Bar 11 composed of the base bar 11(*a*) and whatever additional extension is required is formed with elongated slots 25 to receive headed studs 26 shown in FIGS. 14*a* and 14*b* which overlie the outer surface of the bar throughout the length of the slots 25 except at the enlarged upper ends 27 of slots 25 which allow for the insertion of the studs through the bar into operating position.

Extending laterally outwardly and upwardly of the bar are arms 28 which form with the body of the bar 11 hooked formations 29 which are adapted to engage other studs 26 (FIGS. 14*a* and 14*b*) which are mounted on the sash frame 3 opposite to the hinge side as shown in FIG. 2 and illustrated particularly in FIG. 7 as discussed below.

FIG. 7 is a horizontal cross section showing the sash 2 hinged to the left side of the window frame 1 and the locking mechanism mounted on the right side of the window frame. This view also shows that the window frame 1 carries a screen 31.

FIG. 7 also shows the interaction between the locking bar 1 and the studs 26 carried by the window frame 1 and also the studs 26 carried by sash frame 3.

As shown in FIGS. 14*a* and 14*b*, stud 26 has a cylindrical body 26*a* having a non-round preferably octagonal head 26*b* on each end and a central bore 26*c* to receive a screw 30.

Spaced from the head 26*b* on one end of the stud is an octagonal shoulder 26*d*. The cylindrical body 26*a* between the heads 26*b* and shoulder 26*d* defines a cylindrical engagement surfaces one of which is to be received in the locking bar slots 26 while the stud head 26*b* and the stud shoulder 26*d* overlie opposite sides of the bar to control its sliding motion of bar 11. The other cylindrical surface between the stud head 26*b* and shoulder 26*d* is adapted to cooperate with the locking bar hook 29 is discussed below.

As shown in FIG. 7, each of studs 26 for the locking bar is secured in place by screw 30 with the octagonal head 26*a* of the stud remote from the shoulder 26*d* received in a non-circular depression well 1*w* in the window frame. This well 1*w* being non-circular, and preferably octagonal, provides walls which prevent rotation of the stud 26, as shown in FIG. 7.

In this way, movement of the locking bar 11 will not effect the loosening of the screw 30.

In the same manner, the sash frame 3 is provided with non-circular preferably octagonal wells 3*w* (FIG. 7) which receive studs 26 again secured in place by screws 30.

Figure 16:
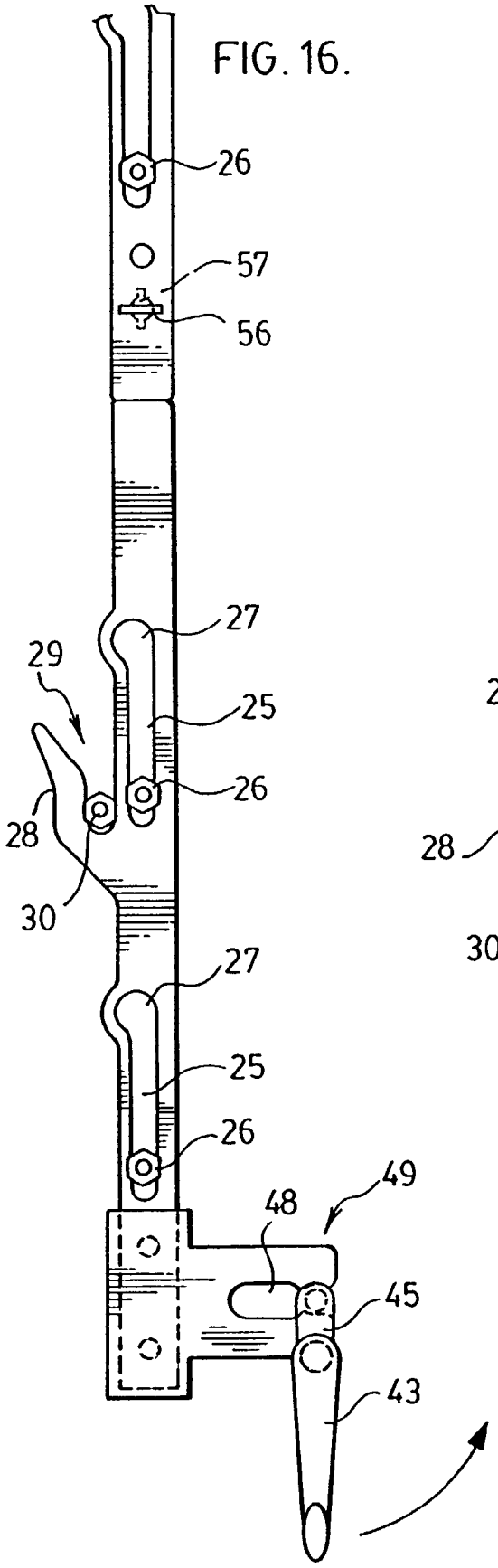
FIG. 16 is an elevational view illustrating the position of the locking lever with the locking bar in the sash locking position.

As illustrated in FIG. 7, again one of the heads 26*b* of the stud 26 is disposed on one side of locking bar 11 while the shoulder 26*d* is disposed on the opposite side of the locking bar 11. It will be understood that when the sash is closed, as illustrated in FIG. 16, the stud heads 26*b* and the shoulders 26*d* will overlie opposite sides of the bar as the studs are received the locking hooks 29. With this arrangement, the studs 26 will prevent the sash when locked from being bowed or deflected under strong winds which otherwise might dislodge the hooks 29 of the bar 11 from the sash studs releasing the sash from its locked condition.

Figure 8:
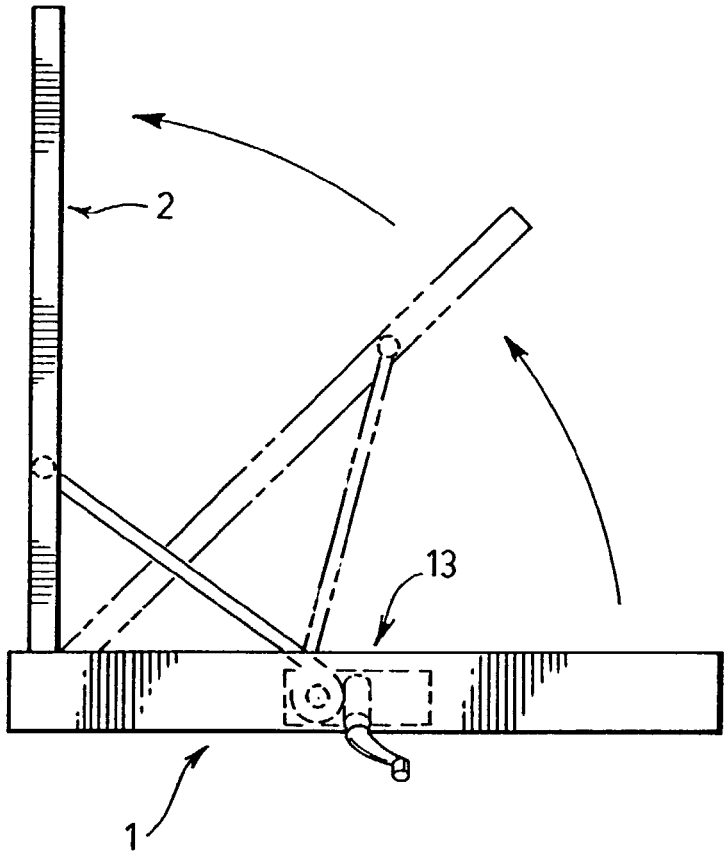
FIG. 8 is a simplified diagrammatic view illustrating the operation of the sash hinged at the left and swinging open to the left.
Figure 9:
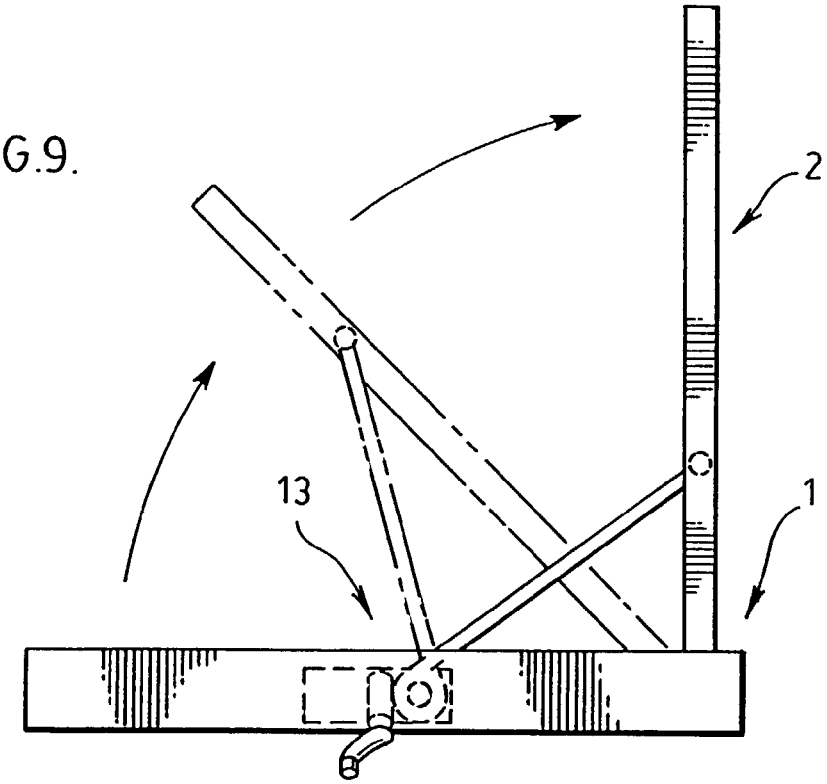
FIG. 9 is a simplified diagrammatic view, similar to FIG. 8, but showing the sash hinged at the right and opening to the right.

FIGS. 8 and 9 are diagrammatic figures illustrating that the sash 2 can be hinged at the left and opened outwardly to the left (FIG. 8) or hinged to the right of the window frame and opened out to the right (FIG. 9). As previously explained when the window fabricator receives the injection molded frames 1 and 3 and the accompanying hardware including the glazing unit locking bars 24, he has the ability to assemble the casement window to swing open either to the left or right to fit the window configuration of his customer without having to carry left and right frames and left and right hardware and, of course, without having to fabricate the frames from lineal extrusions.

Figure 11:
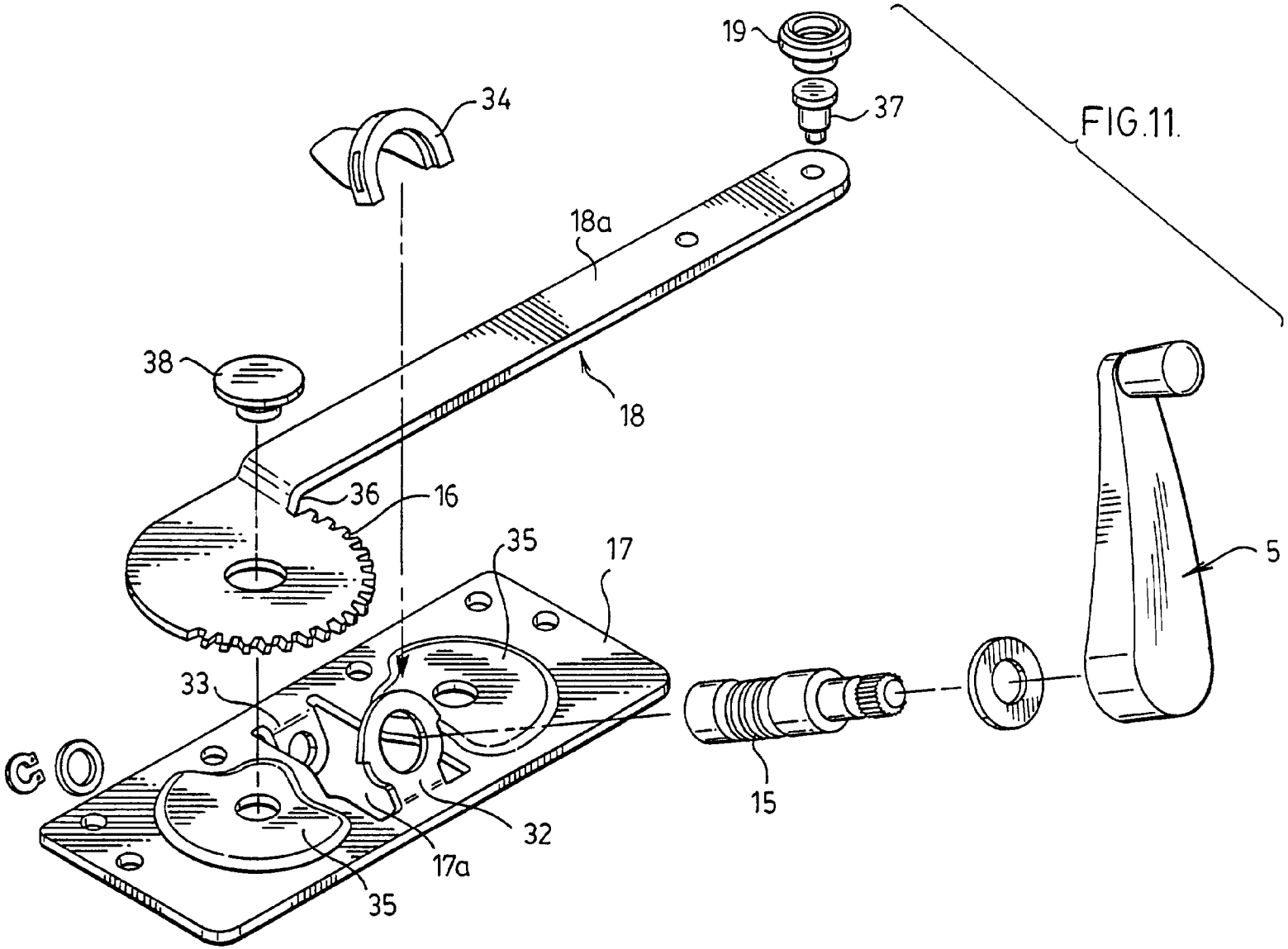
FIG. 11 is an exploded perspective view of the sash operating mechanism.
Figure 12:
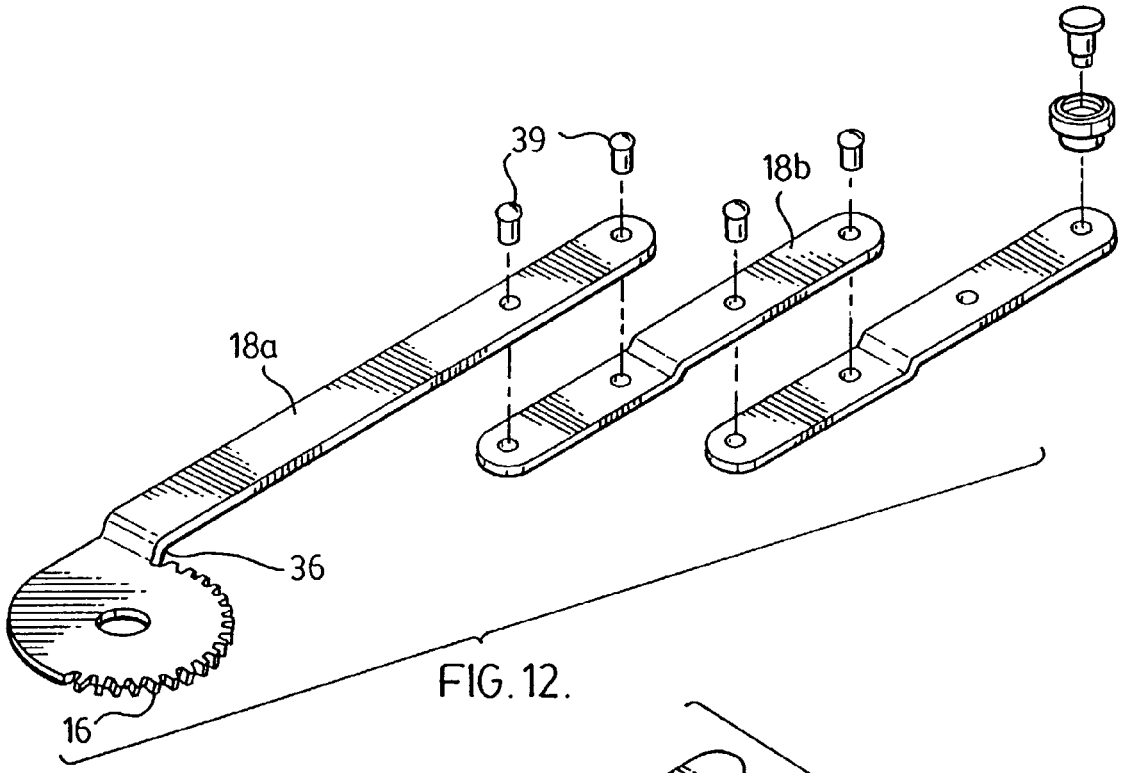
FIG. 12 is a perspective view showing the operating arm provided with extensions to accommodate different widths of windows.
Figure 13:
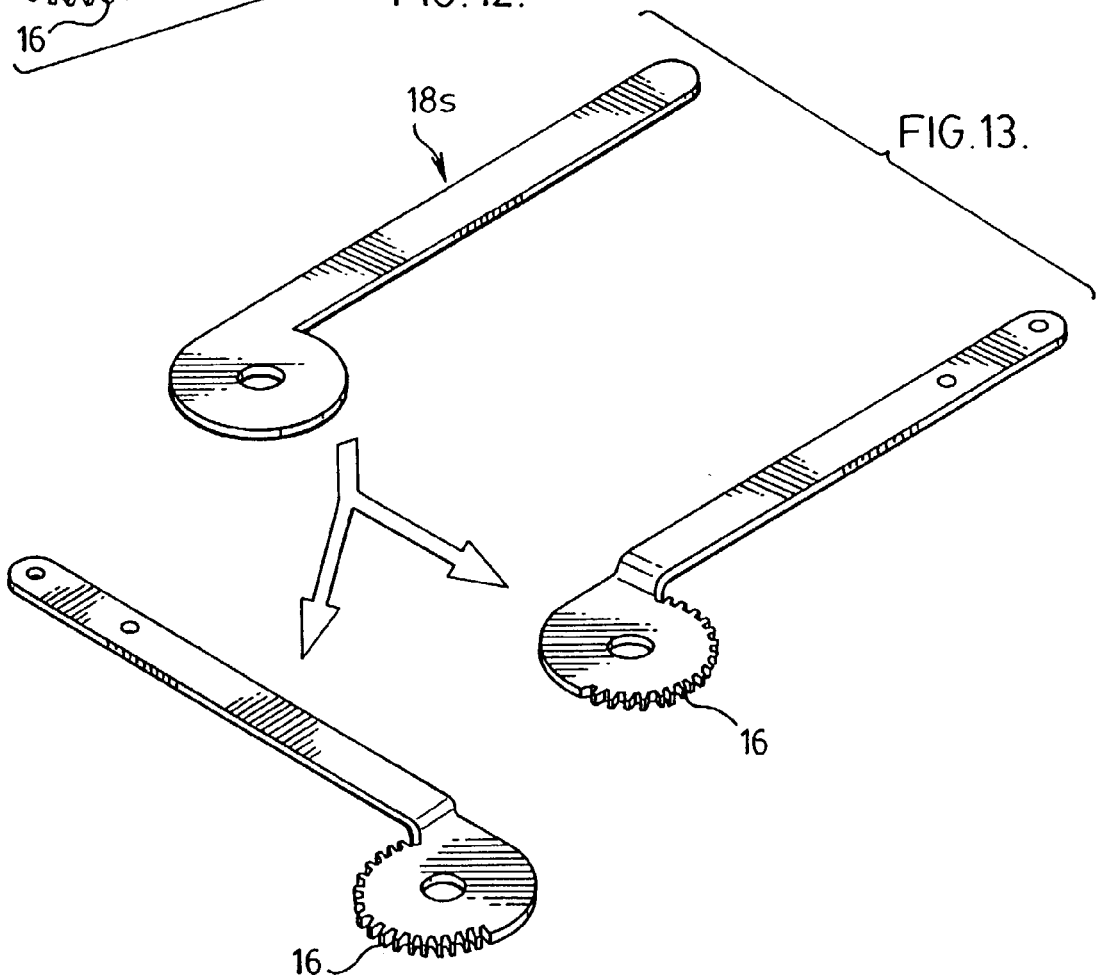
FIG. 13 is a perspective view showing how the operating arm stamping can be formed to provide a gear at the end to open the sash either to the left or the right.

FIGS. 11, 12 and 13 particularly illustrate the operating mechanism.

As shown in FIG. 11, the plate 17 is a stamping with a central opening 17*a*, the material from which is deformed to provide an upwardly and forwardly extending support bushing 32 and a downwardly and rearwardly support bushing 33 to support the worm gear 15 to which the crank arm 5 is secured.

A shroud 34 which interlocks with the bushing 32 is used to secure the worm gear 13 in place.

Either side of the slotted center of the plate 17, the plate is provided with a raised gear mounting platform 35 with the left hand gear mounting platform ready to be used for mounting the gear 16 shown in FIG. 11. As illustrated in this figure, the gear 16 is connected to the operator arm 18 by a neck portion 36 so that the arm 18 is offset above the plate 17.

The wheel 19 is adapted to be secured to the end of the arm 18 by a pin 37. The gear 16 is adapted to be secured to its mounting plate 35 by a pin 38 and the shroud 34 is adapted to interlock with bushing 32.

FIG. 12 shows the base portion 18(*a*) of the operator arm 18 ready to be secured to the extensions 18(*b*) by means of rivets 39.

FIG. 13 shows how an arm stamping 18*s* in the form of a figure six can be machined into an operating arm with a gear portion 16 for cooperation with the worm gear 15 for either a left or right opening window sash.

The vertical movement of the locking bar 11 is effected by the control mechanism 12 attached to the lower end of the bar as illustrated in FIG. 4. To receive this mechanism, the window frame 1 is provided with a slot 40 adjacent the corner 41 of the bottom of the frame jamb through which the control mechanism 12 projects as illustrated in FIG. 4.

Figure 18:
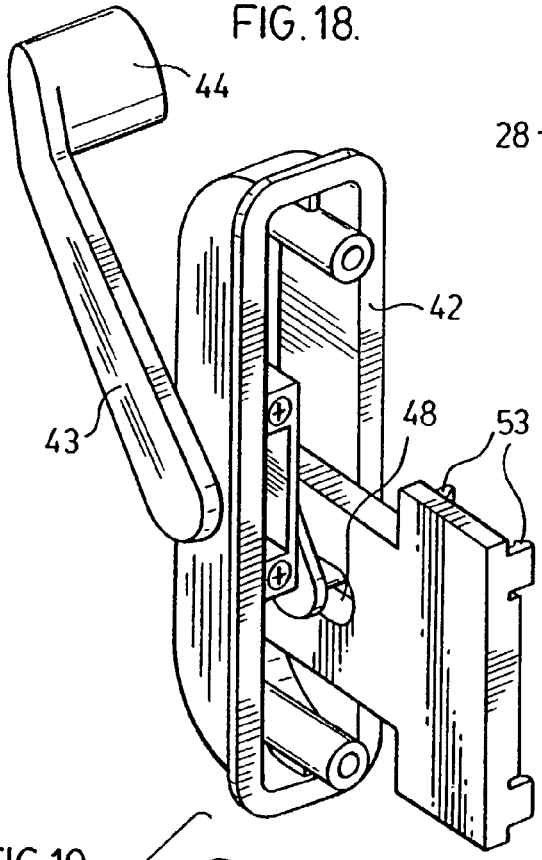
FIG. 18 is an enlarged perspective view of the locking mechanism control.
Figure 19:
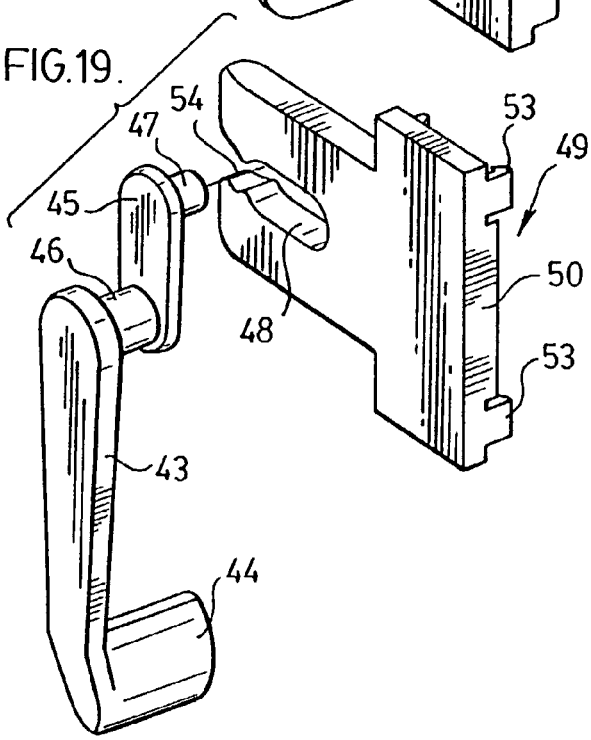
FIG. 19 is an exploded view showing the locking lever adapted to be mounted on the link which is connected to the locking bar.
Figure 20:
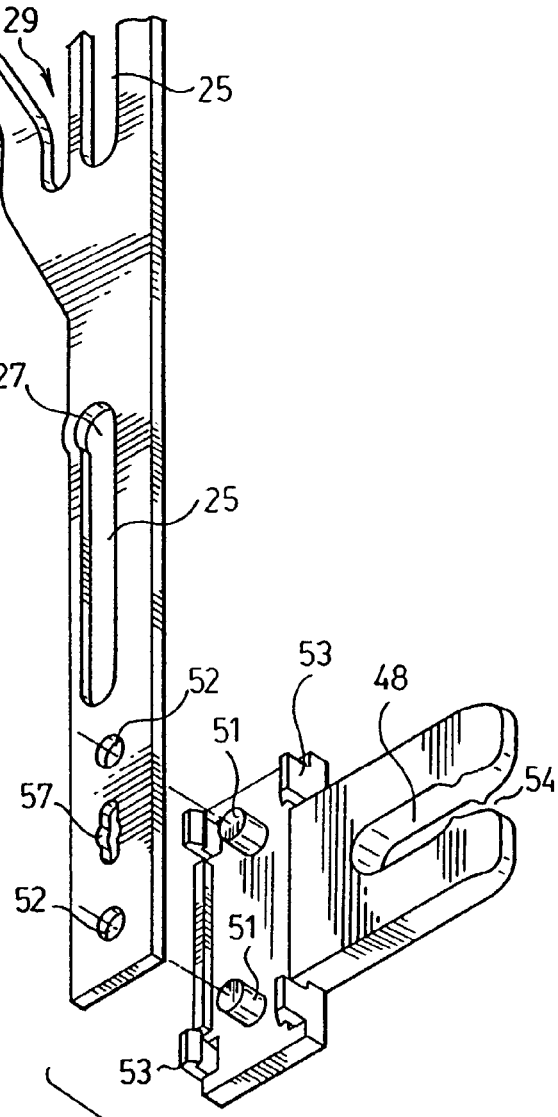
FIG. 20 is an exploded perspective view illustrating the link ready for attachment to the lower end of the locking bar.

The details of the control mechanism 12 are particularly shown in FIGS. 18 to 20.

First turning to FIG. 18, it will be seen that the control mechanism 12 comprises a housing 42 which is mounted to the window frame over the slot 40 as shown in FIG. 1.

Mounted to rotate on the housing 42 is a crank member 43 having a finger grip 44 at one end and a crank arm 45 connected to the other end by a hub 46 about which the crank member rotates on the housing 42.

The crank arm 45 has a projecting pin 47 which engages in a horizontal slot 48 in a link 49 which extends through the window frame slot 40. The link 49 in turn is provided at its end which projects inside the window frame with a mounting platform 50 carrying projecting pins 51 (FIG. 20) which engage in holes 52 at the lower end of the locking bar base section 11(*a*).

The mounting platform 50 of the link 49 also carries projections 53 to engage the sides of the locking bar base for increased stability between the link 49 and the locking bar.

The slot 48 in the link 49 has a restriction 54 at its entrance to provide a feel and also a snap sound during operation of the control mechanism as it reaches the fully unlocked or locked positions as illustrated in FIGS. 14 and 16 respectively.

In this connection, FIG. 14 shows the crank member 43 swung upwardly which moves the pin 47 downwardly to the entrance of the link slot 48 thus causing the link to move downwardly drawing the locking bar 11 downwardly and drawing the hooks 29 downwardly below the studs 26 attached to the sash freeing the sash for opening movement.

FIG. 16 illustrates the fully locked position in which the crank member 43 has been swung downwardly to bring the pin 47 at the end of the crank arm 45 to the entrance of the link slot 48.

In both the fully open and fully closed position of the crank member 43, the pin 47 on the end of the crank arm 45 will have passed through the restriction 54 which will be felt and heard by the operator.

In the fully locked position, the movement of the pin 47 in the slot 48 due to the crank arm 45 will have effected upward movement of the link 49 causing upward movement of the locking bar 11 so that the studs 26 on the sash are fully engaged in the hooks 29 of the locking bar securing the sash in the locked position.

Figure 17:
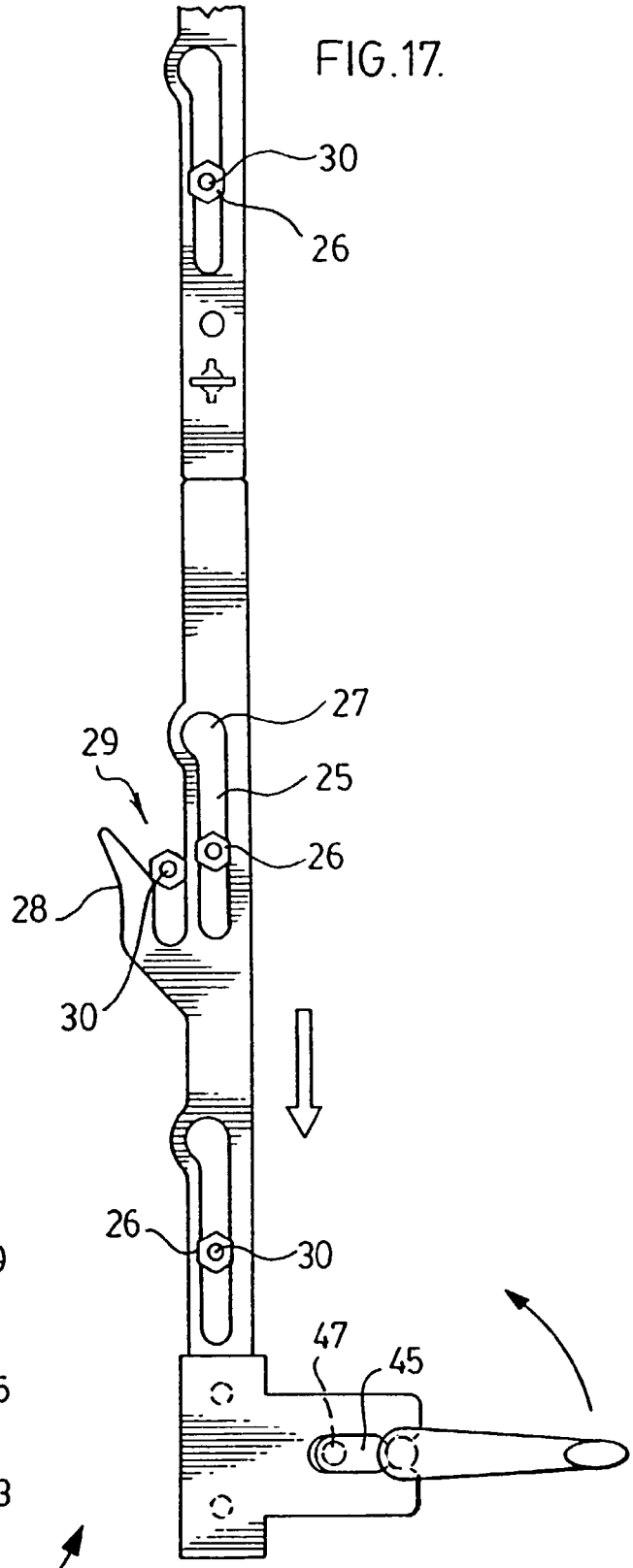
FIG. 17 is an elevational view of the locking bar with the locking lever or handle being moved to draw the locking bar down out of sash locking position.

As illustrated in FIG. 17, as the crank member 43 is moved upwardly, the locking bar 11 is being retracted from the fully locked position.

As the locking bar 11 may be used with windows of different heights and therefore requiring locking bars of different lengths, the locking bar as previously described is made up of the base bar 11(*a*) and extensions 11(*b*).

As shown in FIG. 4, the ends of the base bar 11(*a*) and the extensions 11(*b*) are provided with offset end segments 55 ending in inturned short necked flanges 56 (FIG. 4) while the lower ends of the extensions are provided with vertical slots 57 which flare outwardly at the center, the arrangement being such that the slots 57 will receive the necked flanges 56 of the locking bar portion immediately therebelow with the extension in the horizontal position and, when swung to the vertical position, the necked flange 56 will overlie the upper locking bar member to secure it to the lower locking bar portion.

While FIG. 1 shows the locking mechanism control 12 on the right hand of the window frame 1, the frame will have a similar mounting slot 40 at the opposite side where the window is to be assembled to swing open in the opposite direction to that shown in FIG. 1.

As previously set out, the invention is directed to facilitate the fabricator of casement windows so that he can provide windows to meet the customers requirements with a minimum of assembly operations that are simple and easy to carry without requiring highly skilled craftsmen.

In this connection, for the swingable sash casement windows special easily assembled hinges have been provided which are detailed in FIGS. 21 to 23.

As illustrated in FIG. 21, each of the hinge elements 6 comprises a mounting leg portion 58 having a spacing arm 59. This spacing arm carries at its outer end a hinge barrel carrying arm 60 extending in the opposite direction to the mounting foot. The end of the arm 60 is rolled into the hinge barrel 7. Hinge barrel 7 in turn is adapted to receive a bushing 61.

It will be understood that the hinge members 6 are of identical shape, one for attachment to the window frame 1, the other for attachment to a sash frame 3, so that their hinge barrels 7 are in vertical alignment.

In the case of the upper hinge member 6, the barrel 7 with its inserted bushing 61 is the one which carries the pin 8. This pin 8 is urged out of the barrel 7 by a spring 62 engaging between a collar 63 on the pin 7 and a cap 64 inserted into the upper end of the barrel 7.

It will be understood that normally the pin 8 will be urged to project outwardly of the hinge barrel 7 as illustrated in FIG. 3. However, to assemble the hinging of the sash to the window frame, all that is necessary is to retract the pins 8 which, in the case of FIG. 3, will involved retracting the one pin in the hinge member fixed to the window frame and the other pin in the hinge member fixed to the sash frame and then align the hinge barrels of the window and sash hinge members so that they are in vertical alignment at which time the pins 7 will be automatically projected into the hinge barrel of the under hinge member 6 and the hinge completed as shown in FIG. 23.

It will be understood that the casement window may be installed together with adjoining windows either to the left or right or above or below. To this end, as illustrated in FIGS. 1 and 2 the edges 65 of the window frame project beyond a surrounding flat frame surfaces 66 on both sides of he frame. Mounted in the surfaces 66 are trim receiving bars 67 extending parallel to the frame edges 65 but leaving the corners 68 of the frame surface 66 exposed. With this arrangement, connecting trim strips or bars (not shown) may be run horizontally or vertically between the frame edges 65 and bars 67 to encompass adjoining installed windows to provide a finished appearance.

It will be understood of course that the hinges will be mounted to provide for the swinging of the casement window out in the direction required by the customer and the studs 26 for controlling the sliding movement of the locking bar will be installed at the side opposite to the hinges as will the corresponding studs 26 to be mounted on the sash frame 3 for engagement with the locking bar 11.

It will further be appreciated that whether the sash is hinged to swing open to the left or to the right when swung to the fully open position it will provide an egress opening essentially equal to the full opening of the window frame 1.

It will be understood that while the preferred embodiment described has the window opening operator and window locking controls mounted on the sill rail of the main frame, the window frame or operating mechanisms can be reversed to operate at the top of the window frame. Also the window could be turned on its side so that what is described above as the window frame sill would become a window frame jamb so that the sash would open upwardly or downwardly. In all cases, the open sash provides the full egress opening.

While the preferred embodiments of the invention have been illustrated and described, it will be understood that variations may be made therein without departing from the scope of the appended claims.

The embodiment of the invention in which an exclusive property or privilege is claimed are defined as follows:

1. A casement window comprising an injection molded rectangular window frame having a perimeter formed by a header, a sill, and first and second jambs which define an opening through said frame, said frame having a front side and a rear side and being molded to provide an interior wall formed with an inwardly stepped circumscribing wall portion towards the rear side of said frame, said stepped wall portion extending the full length of said jambs and having predetermined spaced hardware locating and fastener receiving receptacles whose relative positions are precisely coordinated formed therein, a sash comprising a rectangular sash frame having a glazing unit retained therein, said sash frame being hinged to the stepped wall portion of said first jamb to swing about an axis located within both said window frame and said sash frame between an open and a closed position, a slideable locking member to lock and unlock said sash frame respectively when said sash frame is swung to the closed position, said locking member being slideably mounted on the stepped wall portion of said second jamb and secured thereto by fasteners driven into the hardware locating and fastener receiving receptacles of said second jamb, a control for operating said locking member, and means for swinging said hinged sash between said open and closed positions, said sash frame comprising a one piece injection molded frame having a rectangular perimeter and molded with hinge and hardware mounting formations having spaced apart mechanical fastener receiving and hardware locating receptacles on opposite sides thereof inset from the perimeter thereof, said sash being hinged to said first window frame jamb by hinge members secured respectively to the stepped formation of said first jamb and the hinge and hardware mounting formation at one side of said sash frame, said hinge members being connected by hinge pins, and hardware secured to the hinge and hardware mounting formation at the side of said sash frame opposite to said hinge members by fasteners driven into said sash frame receptacles, said latter hardware being adapted to cooperate with said window frame slideable locking member in the locking and unlocking of said sash when in the closed position.

2. A casement window comprising an injection molded rectangular window frame having a perimeter formed by a header, a sill, and first and second jambs which define an opening through said frame, said frame having a front side and a rear side and being molded to provide an interior wall formed with an inwardly stepped circumscribing wall portion towards the rear side of said frame, said stepped wall portion extending the full length of said jambs and having predetermined spaced hardware locating and fastener receiving receptacles whose relative positions are precisely coordinated formed therein, a sash comprising a rectangular sash frame having a glazing unit retained therein, said sash frame being hinged to the stepped wall portion of said first jamb to swing about an axis located within both said window frame and said sash frame between an open and a closed position, a slideable locking member to lock and unlock said sash frame respectively when said sash frame is swung to the closed position, said locking member being slideably mounted on the stepped wall portion of said second jamb and secured thereto by fasteners driven into the hardware locating and fastener receiving receptacles of said second jamb, a control for operating said locking member, means for swinging said hinged sash between said open and closed positions, said sash frame comprising a one piece injection molded frame molded with hinge and hardware mounting formations having spaced apart mechanical fastener receiving and hardware locating receptacles on opposite sides thereof inset from the perimeter thereof, said sash being hinged to said first window frame jamb by hinge members secured respectively to the stepped formation of said first jamb and the hinge mounting formations at one side of said sash frame, said hinge members being connected by hinge pins, and hardware secured to the hardware mounting formations at the side of said sash frame opposite to said hinge members by fasteners driven into said sash frame receptacles, said latter hardware being adapted to cooperate with said window frame slideable locking member in the locking and unlocking of said sash when said sash is in the closed position.

3. A casement window as claimed in claim 2 in which said sash frame has a rectangular front wall defining an opening for accepting said glazing unit and a rectangular rear wall inset from the perimeter of said front wall and projecting rearwardly therefrom, said rear sash frame wail having an outer border surface projecting perpendicular to said front wall, and said mounting formations of said sash frame comprise the outer border surfaces of said rearwardly projecting wall at opposite sides of said sash frame.

4. A casement window as claimed in claim 3 in which said rearwardly projecting sash wall has an inturned glazing unit stop ledge.

5. A casement window as claimed in claim 2 in which said window frame is formed with a narrow inturned wall at the rear of said stepped wall portion projecting inwardly from said header jambs and sill, the portions of said inturned wall projecting inwardly of said jambs having slots therein adjacent to the sill, and said control for said locking member operates through said slot in said wall portion projecting inwardly from said second jamb.

6. A casement window as claimed in claim 5 in which the inturned wall portion extending inwardly of said sill is formed with a central opening therein and said means for swinging said sash between open and closed positions comprises a control mechanism mounted to operate through said central opening, and means connecting said control mechanism to said sash for effecting swinging movement thereof.

7. A casement window as claimed in claim 6 in which said control means for swinging said sash comprises a mounting plate having a central opening, an upturned forwardly canted collar at one side of said opening and a downturned rearwardly canted collar at the other side of said opening, said collars forming end mounts supporting a downwardly and inwardly projecting worm gear, a shroud over said worm gear, an operator gear mounted on said plate to mesh with said worm gear, an operating arm attached to said operating gear, a wheel mounted at the end of said operating arm, and said means for connecting said control mechanism to said sash comprises a trackway mounted on the underside of said sash in which said wheel is engaged.

8. A casement window as claimed in claim 5 in which said control for operating said locking member comprises a housing mounted on the inturned wall portion projecting inwardly from said second jamb, a crank member having a rounded bearing hub extending into said housing, an operating handle secured to said hub located outside said housing, a crank arm connected to said hub and having a projecting operating pin located in said housing and a link extended through said slot formed in said inturned wall projecting inwardly from said second jamb, said link comprising a body portion attached to the lower end of said slideable locking member and a slotted arm for engaging said pin on opposite sides thereof whereby movement of said crank arm pin in said slotted link arm affects upward and downward movement of said link and locking member, said link having a restriction at the entrance to said slot to provide a snap, sound and feel at fully closed and open positions of said locking member.

* * * * *